US008482374B2

(12) United States Patent
Chung

(10) Patent No.: US 8,482,374 B2
(45) Date of Patent: Jul. 9, 2013

(54) LOW-RESISTANCE CARBON GROUNDING MODULE AND METHOD FOR MANUFACTURING THE SAME

(75) Inventor: Young-Ki Chung, Seoul (KR)

(73) Assignee: Omni LPS. Co. Ltd., Seoul (KR)

( * ) Notice: Subject to any disclaimer, the term of this patent is extended or adjusted under 35 U.S.C. 154(b) by 0 days.

(21) Appl. No.: 13/473,315

(22) Filed: May 16, 2012

(65) Prior Publication Data

US 2012/0293300 A1 Nov. 22, 2012

(30) Foreign Application Priority Data

May 19, 2011 (KR) ..... 10-2011-0047563

(51) Int. Cl.
*H01C 7/00* (2006.01)

(52) U.S. Cl.
USPC ..... 338/49

(58) Field of Classification Search
USPC ..... 338/49
See application file for complete search history.

(56) References Cited

U.S. PATENT DOCUMENTS

| | | | | |
|---|---|---|---|---|
| 2,851,570 | A * | 9/1958 | Schaschl | 324/700 |
| 3,390,452 | A * | 7/1968 | Huang | 29/613 |
| 3,808,575 | A * | 4/1974 | Brandt et al. | 338/262 |
| 6,286,206 | B1 * | 9/2001 | Li | 29/840 |
| 2012/0000810 | A1 * | 1/2012 | Dry | 206/524.1 |

FOREIGN PATENT DOCUMENTS

| | | |
|---|---|---|
| EP | 2528068 A2 | 11/2012 |
| JP | 2012243768 | 12/2012 |
| KR | 10-2005-0010566 | 8/2006 |
| KR | 10-2011-0047563 | 9/2011 |

* cited by examiner

*Primary Examiner* — Kyung Lee
(74) *Attorney, Agent, or Firm* — Ballard Spahr LLP

(57) ABSTRACT

The present invention provides a low-resistance carbon grounding module and a method for manufacturing the same, which can increase strength for durability against external environmental changes by varying the type and mixing ratio of raw materials for a carbon resistor without using any heat source. The low-resistance carbon grounding module comprises a carbon resistor extending in the longitudinal direction thereof and a conductive core bar installed in the center of the transverse section of the carbon resistor, wherein the carbon resistor comprises graphite, cement, and feldspar. Thus, it is possible to prevent the durability from being deteriorated due to external environmental changes, water, or electrical resistance, thus improving the quality and reliability of the product while minimizing the production of $CO_2$.

8 Claims, 3 Drawing Sheets

LOW-RESISTANCE CARBON GROUNDING MODULE AND METHOD FOR MANUFACTURING THE SAME

CROSS-REFERENCE TO RELATED APPLICATION

This application claims priority to and the benefit of Korean Patent Application No. 10-2011-0047563, filed on May 19, 2011, the disclosure of which is incorporated herein by reference in its entirety.

BACKGROUND

1. Field of the Invention

The present invention relates to a low-resistance carbon grounding module and a method for manufacturing the same and, more particularly, to a low-resistance carbon grounding module and a method for manufacturing the same, which can increase strength for durability against external environmental changes by varying the type and mixing ratio of raw materials for a carbon resistor.

2. Discussion of Related Art

In general, a grounding device refers to a device that electrically connects communication equipment, electronic measurement equipment, lightning arrester power equipment, etc. to the earth such that a surge voltage, which is caused by overload applied to the equipment or lightning, is applied to the earth.

An example of the grounding device disclosed in Korean Patent No. 10-0610604 (hereinafter referred to as a "prior art") is a low-resistance carbon grounding module with reduced impedance having a structure in which a metal core bar is inserted into a low-resistance resistor comprising a carbon-based non-metallic mineral such as graphite having excellent electrical conductivity and an electrolyte.

Meanwhile, a thundercloud that generates lightning has excess negative (−) charges in summer and excess positive (+) charges in winter, for example. In the event of lightning, the low-resistance carbon grounding module with reduced impedance according to the prior art can rapidly transfer the negative charges in the thundercloud to the earth in summer and rapidly discharge the negative charges in the earth to the thundercloud in winter due to its excellent electrical conductivity.

However, the carbon resistor, a main component of the low-resistance carbon grounding module according to the prior art, is made of a single material such as graphite, and thus when the flow of current from the outside is retarded or when the current is in contact with rainwater, cracks occur in the carbon resistor and the carbon resistor is easily deformed or damaged, which is very problematic.

SUMMARY OF THE INVENTION

The prevent invention has been made in an effort to solve the above-described problems associated with the prior art, and an object of the present invention is to provide a low-resistance carbon grounding module and a method for manufacturing the same, which can increase strength for durability against external environmental changes by varying the type and mixing ratio of raw materials for a carbon resistor.

According to an aspect of the present invention for achieving the above objects, there is provided a low-resistance carbon grounding module comprising: a carbon resistor extending in the longitudinal direction thereof; and a conductive core bar installed in the center of the transverse section of the carbon resistor, wherein the carbon resistor comprises graphite, cement, and feldspar.

The carbon resistor may further comprise magnesium sulfate.

The carbon resistor may further comprise an additive such as sodium nitrite or sodium sulfate.

The carbon resistor may comprise 55 to 70 wt % of graphite, 20 to 30 wt % of cement, 5 to 15 2w% of feldspar, 2 to 4 wt % of magnesium sulfate, and 1 to 3 wt % of an additive with respect to the total weight of the carbon resistor.

The graphite may comprise crystalline graphite and amorphous graphite, which are mixed in a ratio of 2:1.

The graphite may have a particle size of 250 to 350 mesh.

According to another aspect of the present invention for achieving the above objects, there is provided a method for manufacturing a low-resistance carbon grounding module, the method comprising: a mixing step of mixing raw materials of graphite, cement, feldspar, and magnesium sulfate; a slurry preparation step of adding water to the mixed material at a predetermined rate and stirring the resulting mixture to prepare a slurry; a core bar installation step of installing a core bar in the center of a carbon resistor mold; a slurry injection step of injecting the slurry with water into the carbon resistor mold; a vertical extrusion molding step of pressing downward the slurry injected into the carbon resistor mold at a pressure step by step to allow the carbon resistor to have a vertically-stacked shape; a horizontal appearance-finishing step of maintaining the carbon resistor, obtained through the vertical extrusion molding step, horizontal and finishing the appearance of the carbon resistor; and a sealing drying step of sealing the carbon resistor, obtained through the horizontal appearance-finishing step, with a plastic wrap and drying the resulting carbon resistor.

In the mixing step, a material of sodium nitrite or sodium sulfate may be additionally mixed.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Hereinafter, exemplary embodiments of the present invention will be described in detail below with reference to the accompanying drawings such that those skilled in the art to which the present invention pertains can easily practice the present invention.

Figure 1:
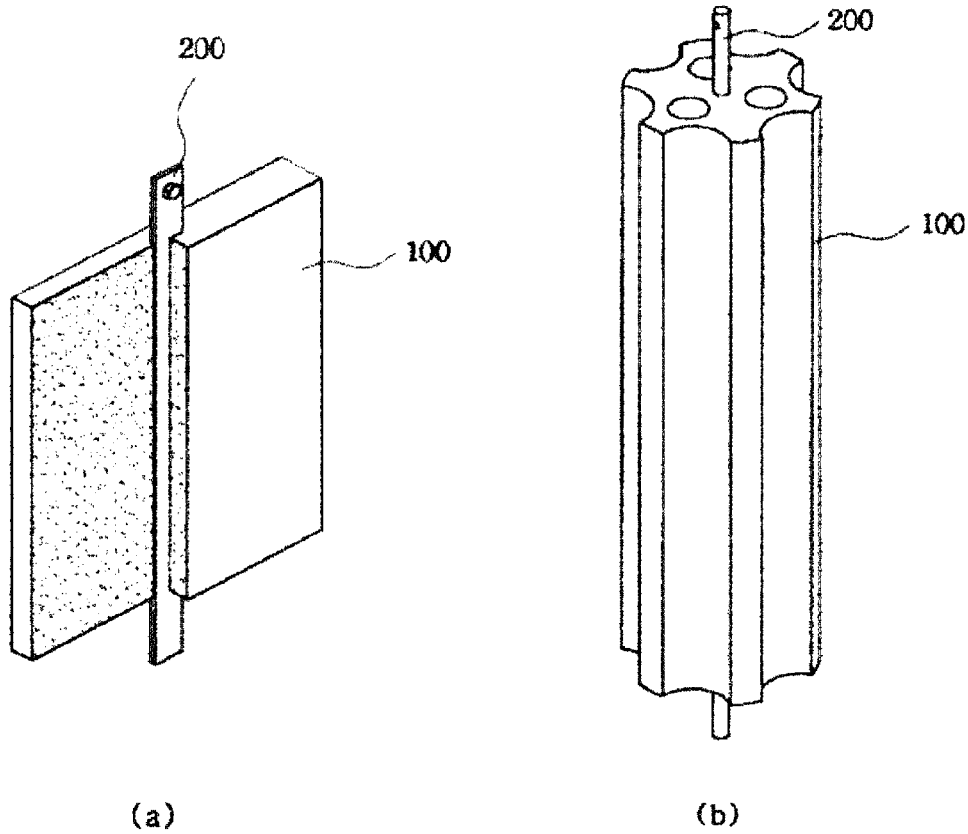
FIG. 1 is perspective views showing the configuration and shape of a low-resistance carbon grounding module in accordance with an exemplary embodiment of the present invention.
Figure 2:
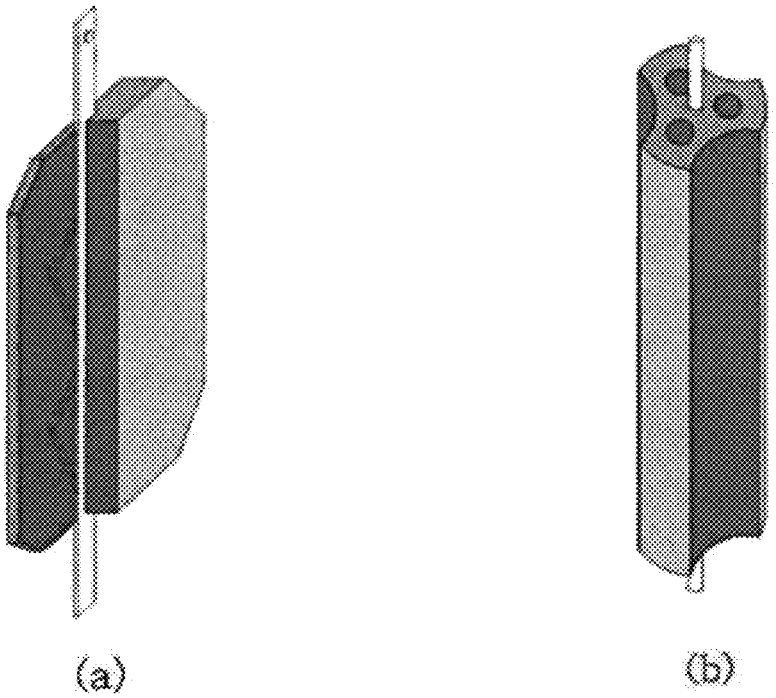
FIG. 2 is perspective views showing other shapes of the low-resistance carbon grounding module in accordance with the exemplary embodiment of the present invention.
Figure 3:
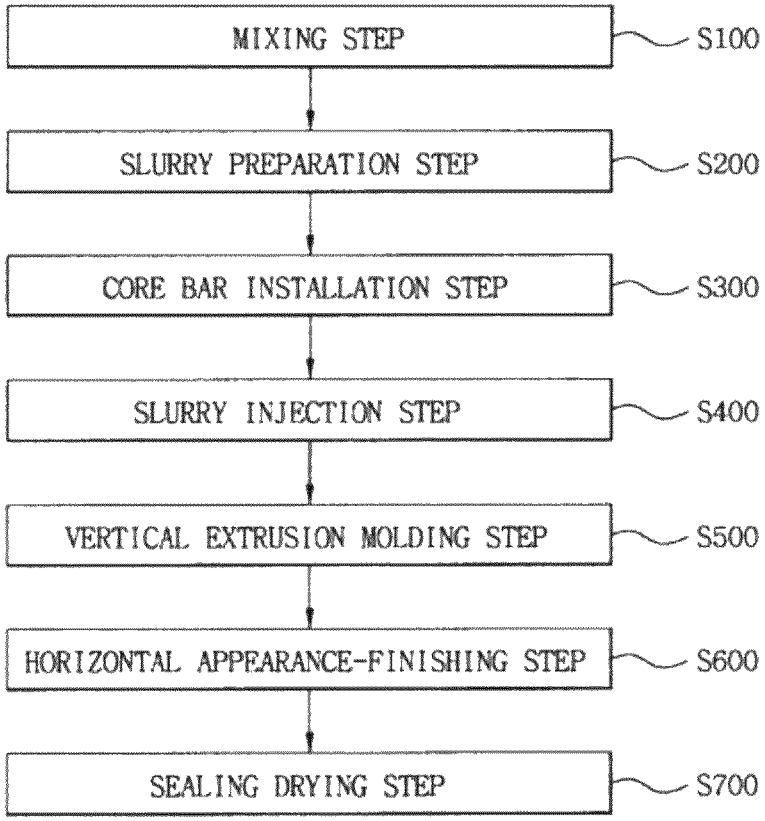
FIG. 3 is a flowchart showing a method for manufacturing a low-resistance carbon grounding module in accordance with exemplary embodiment of the present invention.

As shown in FIGS. 1 and 2, a low-resistance carbon grounding module according to the present invention comprises a carbon resistor 100 extending in the longitudinal direction thereof and a conductive core bar 200 installed in the center of the transverse section of the carbon resistor 100.

The carbon resistor 100 is mainly made of graphite having a low resistance and thus can rapidly transfer a surge voltage such as lightning to the earth, Here, it is preferable that the carbon resistor 100 is formed by mixing graphite, cement, feldspar, magnesium sulfate, and an additive.

For example, the carbon resistor 100 may be configured as shown in the following table 1:

TABLE 1

| Ingredients | Content (weight ratio, %) |
|---|---|
| Graphite | 55 to 70 (more than 95% purity) |
| Cement | 20 to 30 |
| Magnesium sulfate | 2 to 4 |
| Feldspar | 5 o 15 |
| Additive | 1 to 3 |

That is, it is preferable that the carbon resistor 100 comprises 55 to 70 wt % of graphite, 20 to 30 wt % of cement, 5 to 15 wt % of feldspar, 2 to 4 wt % of magnesium sulfate, and 1 to 3 wt % of an additive with respect to the total weight of the carbon resistor 100.

The graphite is a core material for obtaining a low resistance. Conventionally, the graphite is used as a single material, and a small amount of binder (e.g., tar) is added to the graphite to form the shape of the carbon resistor. Here, when the carbon resistor is made of graphite as a main component, it is possible to obtain a high electrical resistance, but the processability for forming the carbon resistor into a predetermined shape and the durability for stably maintaining its shape are significantly reduced.

Accordingly, in the present invention, the content of graphite, the main component of the carbon resistor 100, is reduced to 50 to 70 wt %, and other materials for improving the processability and shape maintenance are additionally used.

Here, if the content of graphite is less than 55 wt %, the strength for the shape is increased, but the conductivity is reduced, whereas, if it exceeds 70 wt %, the conductivity is increased, but the durability for maintaining the shape is significantly reduced.

In particular, the graphite used in the present invention is preferably crystalline graphite having a high purity (95% or higher), but not limited thereto. The graphite having a high purity (95% or higher) may comprise crystalline graphite and amorphous graphite, which are mixed in an appropriate ratio.

Here, it is preferable that the mixing ratio of crystalline graphite and amorphous graphite is maintained at 2:1. Since the crystalline graphite has higher conductivity than the amorphous graphite, it is advantageous to use a greater amount of crystalline graphite in terms of conductivity.

Moreover, it is preferable that the graphite has a particle size of about 250 to 350 mesh.

For example, if the particle size of the graphite is greater than 350 mesh, when a viscous slurry is formed by adding water, the graphite particles tend to float, which makes the mixing process more difficult, and may be lost. Whereas, if the particle size of the graphite is smaller than 250 mesh, the distribution of graphite in the carbon resistor is not uniform, which results in different low-resistance values.

The carbon resistor 100 is formed into a plate-like or cylindrical shape using an extruder which will be described later. The shape of the carbon resistor 100 is not limited to the above, but the carbon resistor 100 may have various shapes such as an oval cylindrical shape, a prismatic shape, etc.

Meanwhile, the cement serves as a binder which improves the strength and durability of the carbon resistor 100.

It is preferable that the cement is contained in an amount of 20 to 30 wt % with respect to the total weight of the carbon resistor 100.

If the content of cement is less than 20 wt %, it is difficult to obtain a sufficient effect of improving the strength and durability of the finished carbon resistor 100, whereas, if it exceeds 30 wt %, it is difficult to obtain a good conductivity, while the strength and durability can be improved.

Here, Portland cement is used as the cement.

In detail, the Portland cement is prepared by mixing a calcareous material and a clayey material in an appropriate ratio (sometimes, a siliceous material and an iron oxide material are used to adjust the components), and the resulting mixture is finely ground and calcined (at about 1,450° C.) until a portion of the mixture is melted, thus obtaining a clinker. Then, to the clinker is added a small amount of plaster as a setting regulator and finely ground. The Portland cement may be prepared by a dry process, a wet process, and a semi-dry process. The dry process involves grinding, mixing, and calcining a dried raw material, and the wet process involve grinding, mixing, and calcining a raw material to which 35 to 40% water is added at a predetermined rate. The wet process requires an amount of heat energy to evaporate excess water contained in the mixture, and thus the use of the wet process for the preparation of cement is reduced.

The main components of the Portland cement include lime (CaO), silica ($SiO_2$), alumina ($Al_2O_3$), and iron oxide ($Fe_2O_3$). The component of the Portland cement clinker include tricalcium silicate (3CaO, $SiO_2$), dicalcium silicate (2Cao $SiO_2$), tricalcium aluminate (3CaO, $Al_2O_3$), and tetracalcium aluminoferrite (4CaO, $Al_2O_3$, $Fe_2O_3$). A solid solution of tricalcium silicate (3CaO, $SiO_2$) with minor oxides such $Al_2O_3$, MgO, etc. is referred to as alite, and a solid solution of β-dicalcium silicate (2Cao $SiO_2$) is referred to as belite.

When mixed with water, the Portland cement loses its liquidity and is set, which is called "setting", and then the resulting cement has strength, which is called "hardening". Among the components of the cement, the tricalcium silicate has high hydration rate and good strength development, which contributes to early strength. The dicalcium silicate has low hydration rate and increases strength over a long time. The tetracalcium aluminoferrite has higher hydration rate than the others and thus rapidly reacts with water to be set.

Meanwhile, the feldspar serves as another binder which further improves the strength and durability of the carbon resistor 100, like the above-mentioned cement. The feldspar serves to reduce the content of the cement, thus effectively reducing the value of the raw materials.

Here, it is preferable that the feldspar is contained in an amount of 5 to 15 wt % with respect to the total weight of the carbon resistor 100.

If the content of feldspar is less than 5 wt %, it is difficult to obtain a sufficient strength to maintain the shape of the carbon resistor 100, whereas, if it exceeds 15 wt %, the surface of the carbon resistor 100 is roughened, and the electrical conductivity is reduced.

Moreover, the carbon resistor according to the present invention should withstand a predetermined breaking load, like a concrete interlocking block for side walk and road.

Thus, if the content of feldspar is above or below a predetermined range, a mechanical strength of the carbon resistor is not maintained. Thus, it is preferable that the carbon resistor according to the present invention has a mechanical strength of at least two-thirds of the breaking load (100 kN) with SB 600 mm for Concrete interlocking block for side walk and road (KSF 4006) specified in Korean Industrial Standards. However, the present invention is not limited thereto, and any strength that does not cause problems during transport and installation according to a user's specification is available.

In general, the feldspar is an aluminosilicate mineral containing potassium, sodium, calcium, and barium and is a major component of granite. The feldspar is composed of three single components such as potassium feldspar, sodium feldspar, and calcium feldspar. A continuous solid solution composed of potassium feldspar and sodium feldspar is called alkali feldspar, and a continuous solid solution composed of calcium feldspar and sodium feldspar is called plagioclase.

Moreover, it is preferable that the magnesium sulfate is contained in an amount 2 to 4 wt % with respect to the total weight of the carbon resistor 100.

The magnesium sulfate functions as a dehydrating agent to prevent the carbon resistor 100 from being softened by water and to improve the conductivity of the soil.

If the content of the magnesium sulfate is less than 2 wt %, it is difficult to expect the effect of dehydration, whereas, if it exceeds 4 wt %, the surface of the carbon resistor 100 is roughened due to formation of crystals.

Furthermore, the additive is used to prevent the conductive core bar 200, which will be described later, from being corroded and contains 1 to 3 wt % of sodium nitrite ($NaNO_2$) or sodium sulfate ($NaSO_4$). The purpose of using the additive is to maintain the electrical conductivity and reduce the grounding resistance.

In particular, if the content of sodium nitrite ($NaNO_2$) or sodium sulfate ($NaSO_4$) as the additive exceeds 3 wt %, it causes toxicity, which contaminates the soil.

Meanwhile, the core bar 200 is a conductor, disposed in the center of the transverse section of the carbon resistor 100, and is made of a material having excellent conductivity such as copper, stainless steel, etc.

Next, a method for manufacturing the low-resistance carbon grounding module in accordance with exemplary embodiment of the present invention will be described.

First, a mixing step (S100) of uniformly mixing raw materials of graphite, cement, feldspar, and magnesium sulfate in a predetermined weight ratio is performed for several minutes.

Then, a slurry preparation step (S200) of adding water to the mixed material at a predetermined rate and stirring the resulting mixture is performed to prepare a slurry.

Here, in the process of stirring the mixture with water, the mixed material is thoroughly stirred by adjusting the rate and amount of water added, thus forming a slurry with water only, not a viscous slurry.

For example, if the mixed material is 20 Kg in weight, it is preferable that 1 L of water is continuously added to the mixed material for 15 minutes and the mixed material is stirred at a stirring rate of 57 to 60 rpm for 15 minutes, but not limited thereto. The addition rate and amount of water and the stirring rate may vary depending on the surrounding environment and temperature.

Then, a core bar installation step (S300) of installing the core bar 200 in the center of a carbon resistor mold is performed.

Subsequently, a slurry injection step (S400) of injecting the slurry with water into the carbon resistor mold is performed.

Next, a vertical extrusion molding step (S500) of pressing downward the slurry injected into the carbon resistor mold at a pressure (13 Mpa□1,885 psi) step by step is performed to allow the carbon resistor 100 to have a vertically-stacked shape. Here, this step is performed at room temperature. If the temperature falls below zero, the stirring process may encounter a problem due to freezing of mixed water.

Then, a horizontal appearance-finishing step (S500) of maintaining the carbon resistor 100, obtained through the vertical extrusion molding step, horizontal and finishing the appearance of the carbon resistor 100 is performed.

Finally, a sealing drying step (S700) of sealing the carbon resistor 100, obtained through the horizontal appearance-finishing step, with a plastic wrap and drying the resulting carbon resistor 100 is performed.

Meanwhile, in the step (S100) of mixing the raw materials for the carbon resistor 100, 1 to 3 wt % of sodium nitrite or sodium sulfate may be additionally mixed.

As described above, according to the present invention, the carbon resistor 100 is formed by mixing graphite, cement, feldspar, and magnesium sulfate, and thus it is possible to prevent the durability of the carbon resistor 100 from being reduced due to external environmental changes, water, or electrical resistance, thus improving the quality and reliability of the product at the same time.

Moreover, the carbon resistor 100 is formed by vertical extrusion molding in a natural state where a heat source using fossil fuel or electrical energy is not used, and thus it is possible to improve the processability and productivity while minimizing the production of $CO_2$.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A low-resistance carbon grounding module comprising:

a carbon resistor extending in the longitudinal direction thereof; and a conductive core bar installed in the center of the transverse section of the carbon resistor, wherein the carbon resistor comprises graphite, cement, and feldspar.

2. The low-resistance carbon grounding module of claim 1, wherein the carbon resistor further comprises magnesium sulfate.

3. The low-resistance carbon grounding module of claim 2, wherein the carbon resistor further comprises an additive such as sodium nitrite or sodium sulfate.

4. The low-resistance carbon grounding module of claim 3, wherein the carbon resistor comprises 55 to 70 wt % of graphite, 20 to 30 wt % of cement, 5 to 15 wt % of feldspar, 2 to 4 wt % of magnesium sulfate, and 1 to 3 wt % of an additive with respect to the total weight of the carbon resistor.

5. The low-resistance carbon grounding module of claim 1, wherein the graphite comprises crystalline graphite and amorphous graphite, which are mixed in a ratio of 2:1.

6. The low-resistance carbon grounding module of claim 5, wherein the graphite has a particle size of 250 to 350 mesh.

7. A method for manufacturing a low-resistance carbon grounding module, the method comprising:

a mixing step of mixing raw materials of graphite, cement, feldspar, and magnesium sulfate;

a slurry preparation step of adding water to the mixed material at a predetermined rate and stirring the resulting mixture to prepare a slurry;

a core bar installation step of installing a core bar in the center of a carbon resistor mold;

a slurry injection step of injecting the slurry with water into the carbon resistor mold;

a vertical extrusion molding step of pressing downward the slurry injected into the carbon resistor mold at a pressure step by step to allow the carbon resistor to have a vertically-stacked shape;

a horizontal appearance-finishing step of maintaining the carbon resistor, obtained through the vertical extrusion molding step, horizontal and finishing the appearance of the carbon resistor; and a sealing drying step of sealing the carbon resistor, obtained through the horizontal appearance-finishing step, with a plastic wrap and drying the resulting carbon resistor.

8. The method of claim 7, wherein in the mixing step, a material of sodium nitrite or sodium sulfate is additionally mixed.

* * * * *